US005230615A

United States Patent [19]

Yoshino et al.

[11] Patent Number: 5,230,615

[45] Date of Patent: Jul. 27, 1993

[54] FUEL INJECTION PUMP HAVING OIL TEMPORARILY-STORING GROOVE

[75] Inventors: Ryokiti Yoshino; Hiroaki Nozaki; Ken Unoki, all of Higashimatsuyama, Japan

[73] Assignee: Zexel Corporation, Tokyo, Japan

[21] Appl. No.: 947,843

[22] Filed: Sep. 21, 1992

[30] Foreign Application Priority Data

Sep. 27, 1991 [JP] Japan ..... 3-277215

[51] Int. Cl.[5] ..... F04B 7/04; F04B 39/02

[52] U.S. Cl. ..... 417/499; 92/153

[58] Field of Search ..... 417/490, 494, 499; 92/158, 159, 153; 184/6.6

[56] References Cited

U.S. PATENT DOCUMENTS

| | | | |
|---|---|---|---|
| 1,462,501 | 7/1923 | Barwald | 92/158 |
| 1,754,625 | 4/1930 | Henning et al. . | |
| 1,846,282 | 2/1932 | Summers | 92/153 |
| 1,937,541 | 12/1933 | Aikman | 92/158 |
| 2,333,698 | 11/1943 | Bremser | 417/494 |
| 2,398,798 | 4/1946 | Meyers | 417/494 |
| 2,791,372 | 5/1957 | Abbatiello | 92/153 |
| 3,721,163 | 3/1973 | Hill et al. | 92/158 |
| 4,067,401 | 1/1978 | Schnell | 92/153 |
| 4,737,086 | 4/1988 | Yamaguchi et al. | 417/499 |

FOREIGN PATENT DOCUMENTS

| | | | |
|---|---|---|---|
| 0301472 | 1/1916 | Fed. Rep. of Germany . | |
| 406055 | 11/1924 | Fed. Rep. of Germany | 92/158 |
| 2007283 | 8/1971 | Fed. Rep. of Germany . | |
| 2235987 | 1/1974 | Fed. Rep. of Germany . | |
| 61-123756 | 6/1986 | Japan . | |
| 62-59765 | 4/1987 | Japan . | |
| 63-123761 | 8/1988 | Japan . | |
| 0182155 | 5/1936 | Switzerland . | |
| 0202316 | 9/1924 | United Kingdom . | |
| 349248 | 5/1931 | United Kingdom | 92/158 |
| 0604305 | 7/1948 | United Kingdom . | |
| 2169357 | 7/1986 | United Kingdom . | |

*Primary Examiner*—Richard A. Bertsch
*Assistant Examiner*—Roland McAndrews
*Attorney, Agent, or Firm*—Sughrue, Mion, Zinn, Macpeak & Seas

[57] ABSTRACT

A fuel injection pump for injecting compressed fuel to an engine through a reciprocative motion of a plunger includes a vertically-elongated plunger barrel, and a plunger having a shaft portion which is vertically and reciprocatively slidable along the inner space of the plunger barrel, at least one of the inner wall of the plunger barrel and the peripheral surface of the shaft portion of the plunger being formed with an oil groove for temporarily storing oil which ascends from a cam chamber through a reciprocative motion of the plunger, wherein the oil groove has at least two side walls one at the upper side of the oil groove and one at the lower side of the oil groove, and wherein lower side wall is downwardly slanted to return the stored oil to the cam chamber.

7 Claims, 3 Drawing Sheets

FUEL INJECTION PUMP HAVING OIL TEMPORARILY-STORING GROOVE

BACKGROUND OF THE INVENTION

1. Field of the Invention

This invention relates to a fuel injection pump, and particularly to a fuel injection pump having a plunger barrel and a plunger at least one of which is formed with an oil groove for temporarily storing an oil ascending from a cam chamber.

2. Description of Prior Art

A fuel injection pump mainly includes a plunger barrel and a plunger which is reciprocatively slidable along the inner space of the plunger barrel. In the fuel injection pump, a fuel injection to an engine or the like is carried out under pressure through the reciprocative motion of the plunger in the plunger barrel. As well known, a gap between the plunger barrel and the plunger is lubricated by an engine oil or the like in order to carry out the reciprocative motion of the plunger smoothly. In general, the engine oil is stored in a cam chamber disposed beneath the plunger, and it upwardly spreads over the gap between the plunger barrel and the plunger through the reciprocative motion of the plunger in the plunger barrel. If no restriction is imposed on the ascending spread of the oil, the fuel which is supplied to a fuel compressed chamber disposed above the plunger would be finally contaminated by the engine oil. The contamination of the fuel by the engine oil induces various troubles as described later, and thus it is necessary to prevent oil from entering the fuel compressed chamber. one of this type of fuel injection pumps is disclosed in Japanese Laid-Open Patent Application No. 61-123756. In this fuel injection pump, as shown in FIG. 9, the shaft portion of a plunger 103 which is reciprocatively slidable along the inner space of a plunger barrel 101 is formed with an oil groove having a rectangular section on the peripheral surface of the plunger 103.

In the conventional fuel injection pump thus constructed, the oil which is temporarily stored in the oil groove 105 is liable to not only flow downwardly (descend) toward the cam chamber, but also flow upwardly (ascend) toward the fuel side with respect to the position of the oil groove 105 with reciprocative motion of the plunger because the groove shape is rectangular and therefore symmetrical with respect to the upward and downward direction. That is, the conventional fuel injection pump has a disadvantage that the ascension of the oil can not be sufficiently suppressed.

The insufficient suppression of the oil ascension to the fuel side causes the following critical problems. Firstly, it causes the increase of consumption of the engine oil because the engine oil is supplied to the cam chamber. Secondly, as described above, it causes the engine oil to contaminate the fuel which will be supplied to the engine under pressure through the reciprocative motion of the plunger. The contamination of the fuel by the engine oil causes exhaust gas to be discolored. Thirdly, the fuel is injected through a fuel filter to a combustion chamber of an engine under pressure by the plunger, and thus the fuel filter is damaged by the engine oil and the exchange life of the fuel filter becomes shorter if the fuel is contaminated by the engine oil.

SUMMARY OF THE INVENTION

An object of this invention is to provide a fuel injection pump in which the ascension of oil is remarkably sufficiently suppressed to thereby depress the consumption of the oil, prevent the contamination of the fuel by the oil and lengthen the exchange life of the fuel filter.

In order to attain the above object, a fuel injection pump includes a vertically-elongated plunger barrel, and a plunger which is vertically and reciprocatively slidable along the inner space of the plunger barrel, at least one of the inner wall of the plunger barrel and the peripheral surface of a shaft portion of the plunger being formed with an oil groove in which oil ascending from a cam chamber for storing the oil due to a reciprocative motion of the plunger is temporarily stored, wherein the oil groove has at least two side walls at the upper and lower sides thereof, one side wall at the upper side being flat while the other side wall at the lower side is downwardly slanted to return the stored oil to the cam chamber.

According to the fuel injection pump having the plunger barrel and the plunger thus designed, the side wall of the groove at the lower side thereof is designed so as to be slanted downwardly, so that the temporarily-stored oil in the groove is more liable to descend to the cam chamber along the downwardly-slanted wall. Consequently, the oil is prevented from ascending to the fuel side, that is, the ascension of the oil to the fuel side is suppressed, and thus the contamination of the fuel by the oil, etc., can be prevented.

DETAILED DESCRIPTION OF PREFERRED EMBODIMENTS

A preferred embodiment of a fuel injection pump according to this invention will be described with reference to FIGS. 1 to 8.

Figure 1:
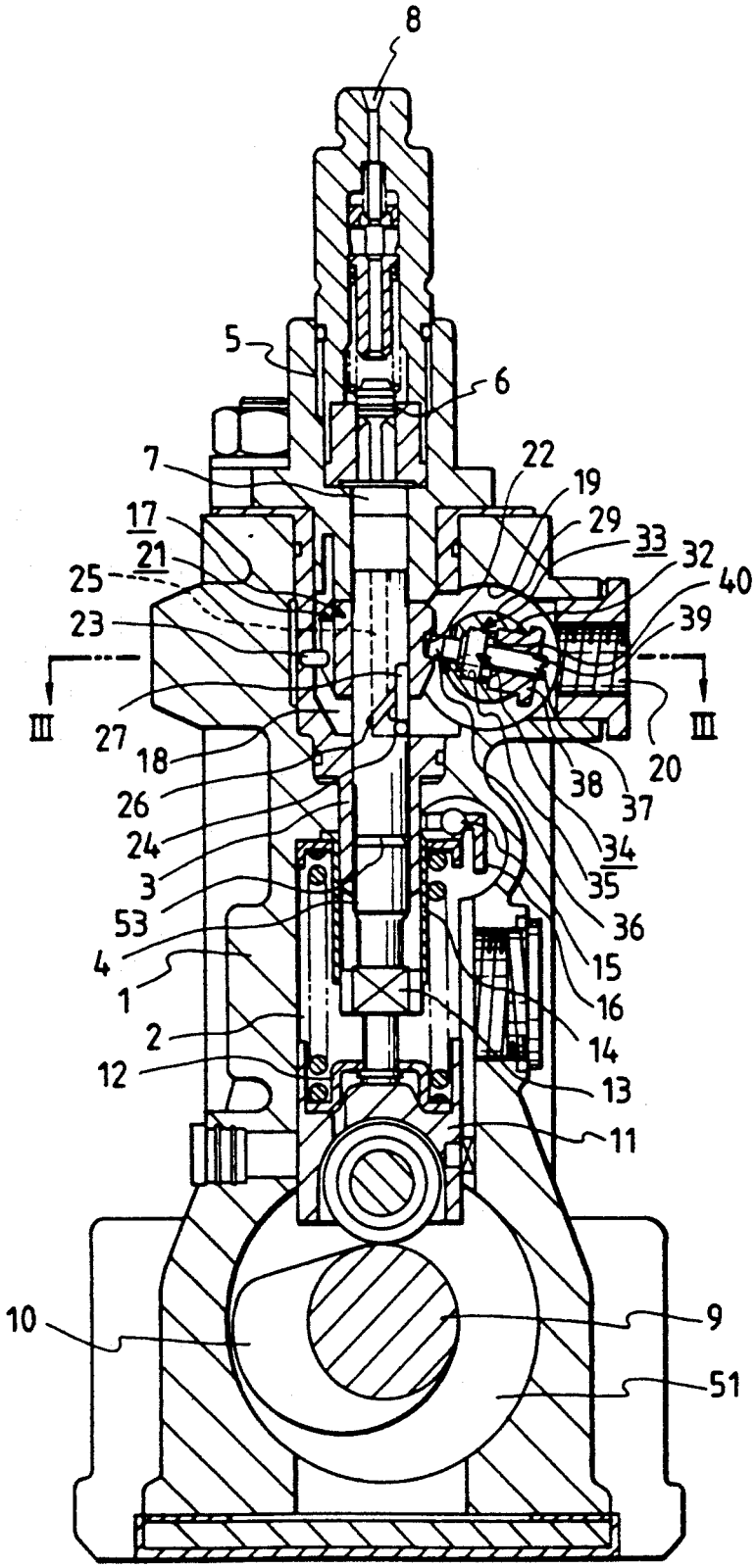
FIG. 1 is a longitudinal-sectional view of an embodiment of a fuel injection pump according to this invention.

FIG. 1 is a longitudinal-sectional view of an embodiment of the fuel injection pump according to this invention.

In FIG. 1, a reference numeral 1 represents a pump body, and the pump body 1 is formed with longitudinally-elongated holes 2 whose number corresponds to the number of cylinders of an engine. A plunger barrel 3 is fixed in each of the longitudinally-elongated holes 2. A plunger 4 is rotatably and reciprocatively inserted into the inner space of the plunger barrel 3, and the top portion of the plunger 4 is inserted inside of a valve housing 5 fixedly secured to the pump body 1. The valve housing 5 is provided with a fuel feed-out valve 6, and a fuel outlet 8 at the upper side of the feed-out valve 6, A fuel compressing chamber 7 for compressing the fuel is formed between the feed-out valve 6 of the valve housing 5 and the plunger 4.

The lower end of the plunger 4 is in contact with a cam 10 formed on a cam shaft 9 through a tappet 11, and the cam shaft 9 is linked to an output shaft of the engine. The cam shaft 9 and the cam 10 are accommodated in a cam chamber 51, and engine oil which is supplied from the engine (not shown) is stored in the cam chamber 51 for lubricating the gap between the plunger barrel 3 and the plunger 4.

Interlockingly with the rotation of the cam shaft 9, the plunger 4 is vertically reciprocated along the inner space of the plunger barrel 3 in a reciprocative motion corresponding to a profile of the cam 10 through the cooperation of the cam 10 and a spring 12. The plunger 4 is provided with a face portion 13 at the lower portion thereof, and the face portion 13 is engaged with an injection-amount adjusting sleeve in such a manner as to restrict the rotational direction of the plunger 4. The sleeve 14 is engaged with an injection-amount adjusting rod 16 through a projection 15, and the plunger 4 is rotated by moving the adjusting rod 16.

Figure 2:
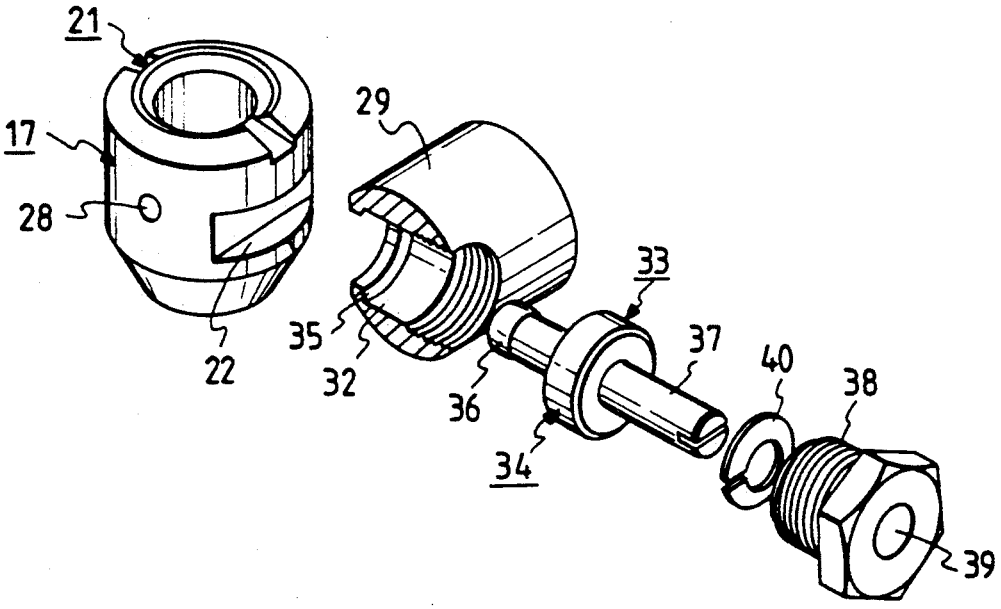
FIG. 2 is an exploded perspective view of a control sleeve of the fuel injection pump as shown in FIG. 1.

A control sleeve 17 is disposed so as to surround the plunger 4 in a fuel reservoir 18 which is surrounded by the inner wall of the plunger barrel 3. The fuel reservoir 18 is intercommunicated to a fuel inlet 20 through a lateral hole 19 formed in the pump body 1. As shown in FIG. 2, the control sleeve 17 is formed with a longitudinally-elongated guide groove 21 in the rear side thereof, and a laterally-elongated engaging groove 22 in the front side thereof. The guide groove 21 is engaged with a guide pin 23 provided in the plunger barrel 3 so that the control sleeve 17 is permitted to move only in the vertical (longitudinal) direction while it is inhibited from moving in the lateral direction. On the other hand, the engaging groove 22 is engaged with a control rod 29 as described later.

The plunger 4 is further formed with a fuel suction-/exhaust hole 24 which extends radially from the center portion of the plunger 4 and opens to the fuel reservoir 18, a intercommunicating hole 25 which extends in an axial direction of the plunger and intercommunicates the fuel suction/exhaust hole 24 with the fuel compressing chamber 7, a slant groove 26 which extends at an angle on the outer surface of the plunger 4, and a longitudinal groove 27 intercommunicating the slant groove 26 to the opened portion of the fuel suction/exhaust hole 24. The control sleeve is further formed with a cut-off hole 28 extending in a radial direction thereof.

An operation of the fuel injection pump according to this embodiment will be next described.

As shown in FIG. 1, at an initial stage of the fuel injection operation where the plunger 4 is about to ascend (move upwardly) from a bottom dead center, the fuel suction/exhaust hole 24 is opened to the fuel reservoir 18 and thus the fuel compressing chamber 7 and the fuel reservoir 18 are intercommunicated to each other through the fuel suction/exhaust hole 24 and the intercommunicating hole 25. Therefore, the pressure of the fuel in the fuel compressing chamber 7 is not increased, and thus the fuel feed-out valve 6 is still closed.

In the above state, when the plunger 4 is moved upwardly along the inner space of the plunger barrel 3 and the fuel suction/exhaust hole 24 is located at a position above the lower end surface of the control sleeve 17, the fuel suction/exhaust hole 24 is closed by the inner wall of the control sleeve 17, so that the pressure of the fuel in the fuel compressing chamber 7 is increased to open the fuel feed-out valve 6 and thus the fuel is injected from the fuel outlet 8.

The motion (or moving distance) of the plunger 4 from a time when the plunger is located at its bottom dead center thereof to a time when the fuel suction/exhaust hole 4 is closed, corresponds to a so-called pre-stroke of the plunger 4, and the fuel injection is started at the time when the fuel suction/exhaust hole 24 is closed. When the plunger 4 is further upwardly moved and the slant groove 26 is intercommunicated to the cut-off hole 28, the fuel compressing chamber 7 and the fuel reservoir 18 are intercommunicated to each other through a passageway extending from the intercommunicating hole 25 through the fuel suction/exhaust hole 24, the longitudinal groove 27 and the slant groove 26 to the cut-off hole 28. Therefore, the fuel in the fuel compressing chamber 7 flows out into the fuel reservoir 18, and the pressure of the fuel in the fuel compressing chamber 7 is decreased, whereby the fuel feed-out valve 6 is closed.

The fuel injection is finished at the time when the slant groove 26 is intercommunicated to the cut-off hole 28 as described above, and the motion (moving distance) of the plunger 4 from the start of the fuel injection to the end of the fuel injection corresponds to an effective stroke of the plunger 4. The effective stroke of the plunger 4 is adjustable by rotating the plunger 4 with the injection-amount adjusting rod 16, and the pre-stroke of the plunger 4 is also adjustable by vertically (upwardly or downwardly) moving the control sleeve 17 with the control rod 29.

Figure 3:
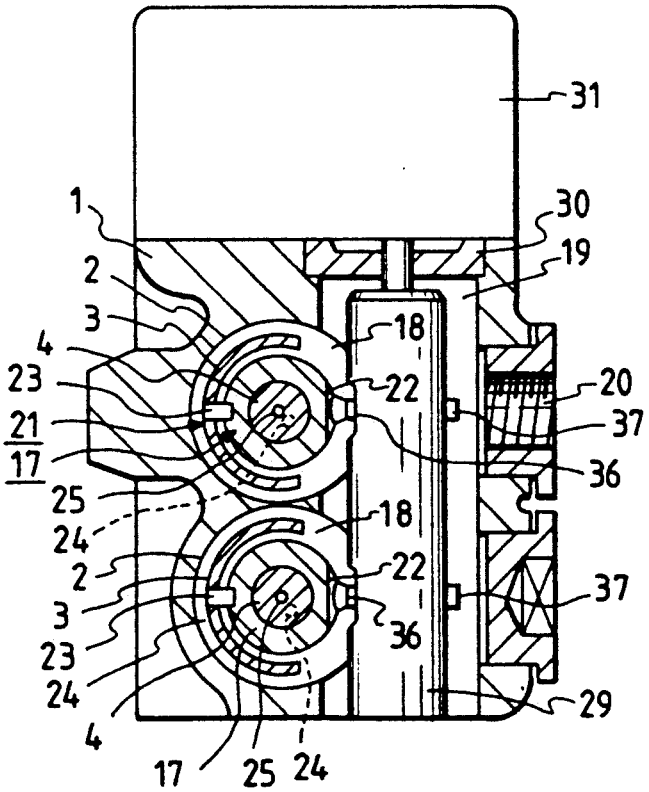
FIG. 3 is a cross-sectional view of the fuel injection pump as shown in FIG. 1 which is taken along a line III—III.

As shown in FIG. 3, the control rod 29 is inserted into the lateral hole 19, and freely rotatably supported through a bearing 30 by the pump body 1. In addition, the control rod 29 is linked to an actuator 31 such as a stepping motor, and is rotated by the actuator 31. As shown in FIG. 2, the control rod 29 is formed with a window portion 32 which penetrates through the control rod 29 in the radial direction of the rod 29 so as to confront the control sleeve 17, and an engaging shaft 33 is engaged with the window portion 32 of the control rod 29. The engaging shaft 33 has at the central portion thereof a disk-shaped body 34 which is freely rotatably engaged with a stepped portion 35 formed in the window portion 32, and is provided with an engaging portion 36 at one end portion thereof. The engaging portion 36 is secured to the engaging shaft 33 in such a manner as to be eccentric to the disk-shaped body 34 and extend through the window portion 32 to the control sleeve 17 side, and is engaged with the engaging groove 22 of the control sleeve 17. The engaging shaft 33 is further provided with an adjusting rod portion 37 at the other end thereof (at the non-engaging side thereof), and the adjusting rod portion 37 is designed so as to be insertable into a center hole 39 formed in a cap screw 38. The cap screw 38 is spirally engaged with the window portion 32 to push the disk-shaped body 34 of the engaging shaft 33 through a washer 40 toward the control sleeve 17.

The control sleeve 17 and the control rod 29 thus constructed constitutes a pre-stroke varying mechanism. That is, in response to a control signal from a control unit (not shown), the actuator 31 is driven to rotate the control rod 29, and interlockingly with the rotation of the control rod 29 the control sleeve 17 is vertically (upwardly and downwardly) moved, whereby the relative position between the control sleeve 17 and the plunger 4 in the vertical direction is varied. Since the timings of the start of the fuel injection and the end of the fuel injection are varied using the mechanism as described above irrespective of the non-variation of the effective stroke of the plunger 4, an injection period (an injection period and an injection rate if an inconstant-speed cam is used as the cam 10) can be varied (adjusted).

In the pre-stroke varying mechanism thus constructed, the contact portion of the plunger 4 with the other elements in its reciprocative motion is divided into three stages (upper, intermediate and lower portions) of the plunger 4. The upper portion of the plunger 4 is contacted with the valve housing 5, the intermediate portion of the plunger 4 is contacted with the control sleeve 17 and the lower portion of the plunger 4 is contacted with the inner wall of the plunger barrel 3. Therefore, the fuel injection pump having the pre-stroke varying mechanism has a construction that the oil is liable to be upwardly sucked (ascend upwardly) from the cam chamber.

In this embodiment, in order to prevent the suck-up (ascension) of the oil, an oil groove having a peculiar profile as described below in which the oil ascending from the cam chamber 51 is temporarily stored is formed in the shaft portion of the plunger 4 at the lower portion of the plunger 4, or in the inner wall of the plunger barrel 3 at the position corresponding to the lower portion of the plunger 4. Various oil grooves having various profiles as shown in FIGS. 4 to 8 may be used, however, these oil grooves are commonly designed so as to have at least two side walls at the upper and lower sides thereof in the vertical direction (the oil ascending/descending direction), one side wall at the upper side (in the oil ascending direction) being flat while the other side wall at the lower side (in the oil descending direction) is partially or wholly slanted in the downward direction. The oil which is temporarily stored in the oil groove is downwardly returned to the cam chamber 51 along the slanted surface of the side wall of the oil groove.

Figure 4:
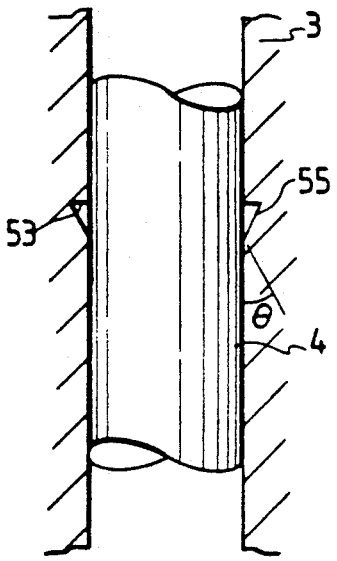
FIG. 4 is a front view of an oil groove of the fuel injection pump according to this invention.

FIG. 4 shows an embodiment of the oil groove. The oil groove 53 of this embodiment is designed so that the side wall 55 at the lower side thereof conically extends in the downward direction from the flat side wall at the upper side thereof. According to the oil groove thus constructed, the oil which ascends from the cam chamber 51 with reciprocative motion of the plunger 4 is temporarily stored in the oil groove 53, and the temporarily-stored oil is liable to flow downwardly along the slant surface of the side wall 55 while the temporarily-stored oil hardly flows upwardly (ascend to the fuel side). Therefore, the consumption of the oil stored in the cam chamber 51 is reduced, the contamination between the fuel compressed by the plunger 4 and the oil is sufficiently suppressed to prevent the discoloring of the exhaust gas, and the exchange life of the fuel filter is lengthened.

Figure 5:
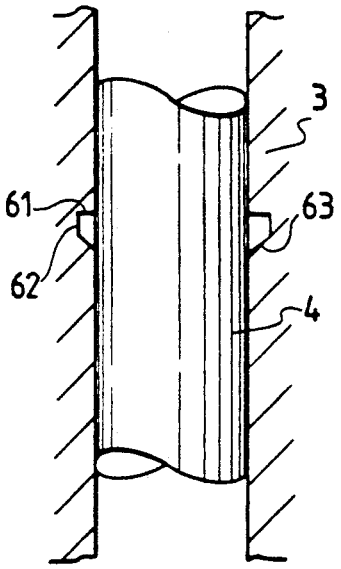
FIG. 5 is a front view of a modification of the oil groove as shown in FIG. 4.

FIG. 5 shows a modification of the oil groove as shown in FIG. 4. In this modification, an oil groove 61 is formed with a bottom surface 62 between the flat side wall and the slant side wall 63, so that the profile of the oil groove is substantially trapezoidal.

Figure 6:
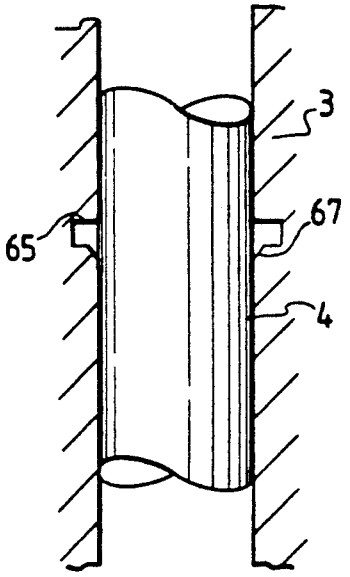
FIG. 6 is a front view of another modification of the oil groove as shown in FIG. 4

FIG. 6 shows another modification of the oil groove as shown in FIG. 4. In this modification, an oil groove 65 is so designed as to be substantially rectangular in section. However, the lower side wall of the oil groove at the lower side (in the oil descending direction) is slightly slanted (for example, only the upper portion of the lower side wall is slanted).

Figure 7:
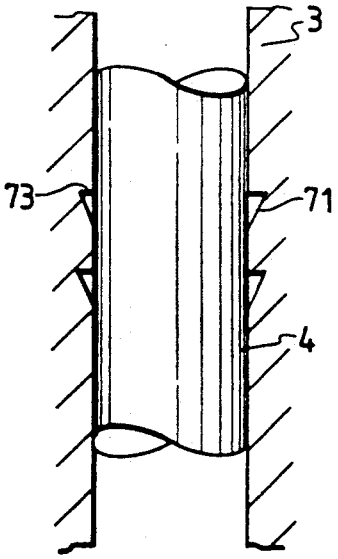
FIG. 7 is a front view of another modification of the oil groove as shown in FIG. 4.

FIG. 7 shows another modification of the oil groove as shown in FIG. 4. In this modification, an oil groove 73 is formed with a flat upper side wall at the upper side thereof and a downwardly-slant lower side wall at the lower side thereof, and two oil grooves 73 thus constructed are formed on the peripheral surface of the shaft portion of the plunger 4 in tandem.

Figure 8:
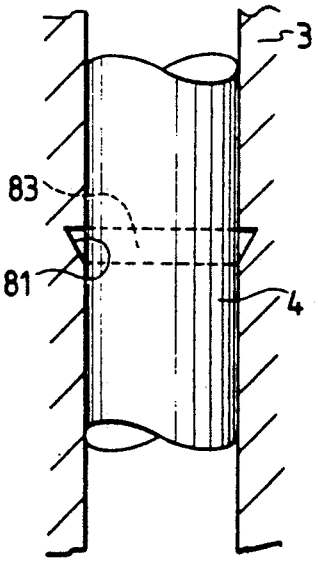
FIG. 8 is a front view of the inner wall of a plunger barrel on which a groove is formed.
Figure 9:
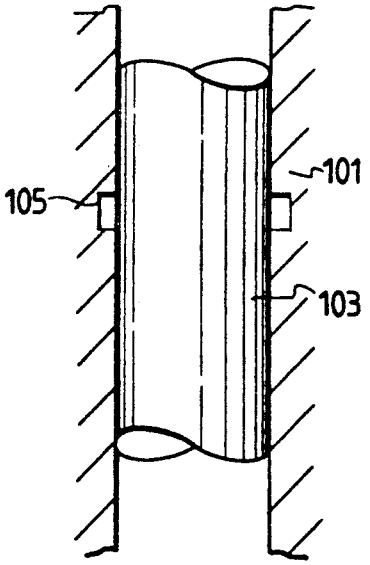
FIG. 9 PRIOR ART
FIG. 9 is a front view of a conventional oil groove.

In the above embodiments of the oil grooves as shown in FIGS. 4 to 7, the oil groove is formed on the shaft portion of the plunger 4. In place of the oil groove formed on the plunger side, as shown in FIG. 8 an oil groove 83 having at least one flat upper side wall and one downwardly-slanted lower side wall 81 may be formed on the inner peripheral surface of the plunger barrel 3.

In short, according to the oil groove of this invention, it is important to provide a slant surface having a suitable inclined angle at the lower side wall of the oil groove. If the inclined angle $\theta$ of the slant surface is excessively small, the oil is excessively returned to the cam chamber 51, the plunger 4 is insufficiently lubricated. On the other hand, if the inclined angle $\theta$ of the slant surface is excessively large, the ascension of the oil is not sufficiently suppressed. In this embodiment, the inclined angle $\theta$ is set to approximately 30°.

The upper side wall of the groove is not limited to a flat surface, but it is inhibited from being slant upwardly because the upwardly-slanted surface of the upper side wall depresses a scrape-out effect of the oil which is inherent to the side wall of the oil groove.

The foregoing description is made to a representative embodiment of this invention. However, this invention is not limited to the above embodiment. For example, the above embodiment pertains to a fuel injection pump equipped with a prestroke varying mechanism. However, the same effect of preventing the ascension of the oil to the fuel side can be obtained when this invention is applied to other types of fuel injection pumps.

As described above, according to the fuel injection pump of this invention, an oil groove having at least one flat upper side wall and one downwardly-slanted lower side wall is formed in a shaft portion of a plunger which is vertically slidable along the inner space of the plunger barrel or in the inner wall of the plunger barrel. Therefore, the oil which ascends from the cam chamber interlockingly with the reciprocative motion of the plunger is temporarily stored in the oil groove, and then the temporarily-stored oil groove is more liable to flow downwardly (descend to the cam chamber) while it hardly flows up (ascend to the fuel side). That is, the ascension of the oil to the fuel side is sufficiently suppressed.

What is claimed is:

1. A fuel injection pump for injecting compressed fuel to an engine through a reciprocative motion of a plunger, comprising:

a vertically-elongated plunger barrel; and a plunger having a shaft portion which is vertically and reciprocatively slidable along the inner space of said plunger barrel, an inner wall of said plunger barrel being formed with an oil groove for temporarily storing oil which ascends from a cam chamber through a reciprocative motion of said plunger, wherein said oil groove has at least two side walls, one at an upper side of said oil groove and one at a lower side of said oil groove, and wherein the lower side wall is downwardly slanted to return the stored oil to said cam chamber.

2. The fuel injection pump as claimed in claim 1, wherein said oil groove has a substantially V-shaped section.

3. The fuel injection pump as claimed in claim 1, wherein said oil groove has a bottom surface between said upper side wall and said slanted lower side wall to form a substantially trapezoidal section.

4. The fuel injection pump as claimed in claim 1, wherein said oil groove is substantially rectangular in section, said lower side wall of said rectangular oil groove being only slightly slanted.

5. The fuel injection pump as claimed in claim 1, wherein a plurality of said oil grooves are formed in tandem along the inner wall of said plunger barrel.

6. The fuel injection pump as claimed in claim 1, wherein said upper side wall of said oil groove is flat.

7. A fuel injection pump for injecting compressed fuel to an engine through a reciprocative motion of a plunger, comprising:

a vertically-elongated plunger barrel; and a plunger having a shaft portion which is vertically and reciprocatively slidable along the inner space of said plunger barrel, an inner wall of said plunger barrel being formed with an oil groove for temporarily storing oil which ascends from a cam chamber through a reciprocative motion of said plunger, wherein said oil groove has at least two side walls, one at an upper side of said oil groove and one at a lower side of said oil groove, and wherein a peripheral portion of said lower side wall is downwardly slanted to return the stored oil to said cam chamber.

* * * * *